United States Patent [19]

Braaten

[11] 3,966,546

[45] June 29, 1976

[54] APPARATUS FOR MANUFACTURING SLEEVES FROM FIBER PULP

[75] Inventor: Terje Braaten, Ed, Sweden

[73] Assignee: Renee Engell, Oslo, Norway

[22] Filed: May 10, 1974

[21] Appl. No.: 469,042

[52] U.S. Cl. ..... 162/293; 162/297; 162/305

[51] Int. Cl.[2] ..... D21F 1/00

[58] Field of Search ..... 162/289, 293, 297, 305, 162/310, 202; 425/85, 380, 325, 389, 393; 264/87

[56] References Cited

UNITED STATES PATENTS

| | | | |
|---|---|---|---|
| 2,549,686 | 4/1951 | Hjulian | 162/293 |
| 3,021,254 | 2/1962 | Helversen et al. | 162/293 X |
| 3,671,386 | 6/1972 | Jakobsen et al. | 162/293 X |
| 3,686,070 | 8/1972 | Williams | 162/293 |
| 3,804,707 | 4/1974 | Mohr et al. | 162/305 X |

*Primary Examiner*—Robert L. Lindsay, Jr.
*Assistant Examiner*—Marc L. Caroff
*Attorney, Agent, or Firm*—Browdy and Neimark

[57] ABSTRACT

Apparatus for manufacturing sleeves of fiber pulp by passing fiber pulp through a nozzle including a mandrel extending through the nozzle and a reciprocating piston mounted on the mandrel to exert pressure on the pulp. Screen members are located on the interior surface of the nozzle, the exterior surface of the mandrel, and the end surface of the piston in conjunction with suction means to provide for dewatering of the pulp.

7 Claims, 2 Drawing Figures

APPARATUS FOR MANUFACTURING SLEEVES FROM FIBER PULP

Figure 1:
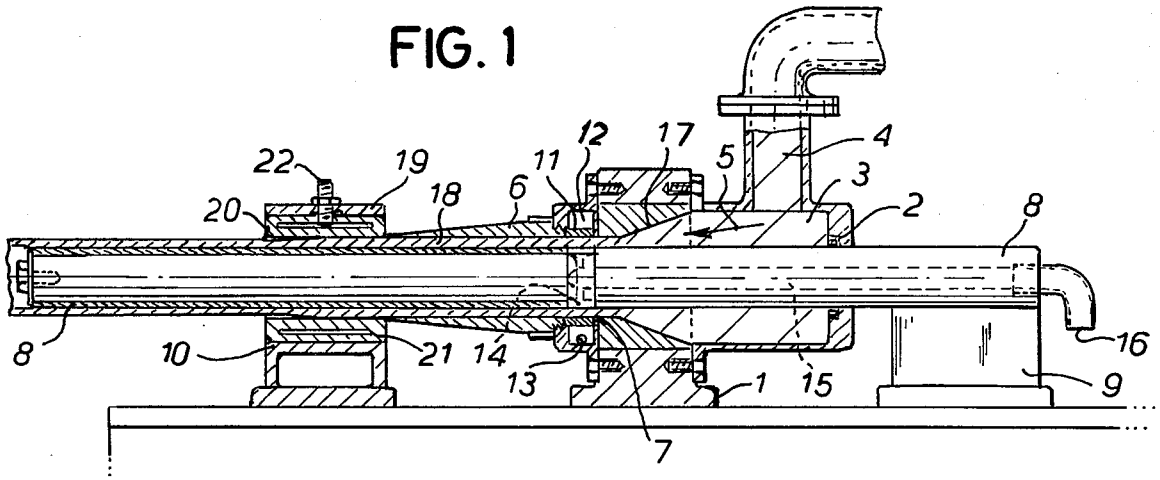

The present invention relates to an apparatus for the manufacture of sleeves from fibre pulp, particularly wood fibre pulp. Sleeves of this type are used for many different purposes, and are particularly in connection with the present invention intended used as cores for paper rolls.

Sleeves for this purpose are expensive to produce inasmuch as the starting material, for example, wood fibre pulp, must first be formed to paper and thereafter wound, in the form of strips, to sleeves consisting of a large number of paper layers extending in different directions. This method of production is elaborate and expensive, and the aim of the present invention is to eliminate this disadvantage. This is achieved in that, by means of the apparatus in accordance with the invention, it is possible to press or extrude fibre pulp also in long and perhaps continuous lengths which are thereafter divided into sleeves of the particular dimension desired.

It is previously known to extrude materials in tubular form, extrusion is widely used, for example, in the plastic industry; and metals, for example, lead and aluminum, can be extruded under high pressure. Extrusion is an inexpensive method of production since the starting material is formed direct to the desired final product with no intermediate production steps.

Previously known extruding equipment and methods cannot be used for extrusion of fibre pulp, for example wood fibre pulp, asbestos fibre pulp and the like, however, and the object of the invention is primarily to provide an apparatus which allows extrusion also of such materials.

Fibre pulp is slurried in a liquid which is to be removed and this causes a constructional problem which has never hitherto been solved. The problem is solved by means of the present invention, in that a suction ring is provided in the inlet of the nozzle which forms the pulp when the pulp is forced through the nozzle, the said suction ring removing the greater part of the water to be forced out of the fibre pulp when forming this to a self-supporting tube which, after further drying, is hard and strong.

The nozzle forms the outer side of the tube or sleeve, the inner side being formed by a mandrel which projects through the nozzle, the nozzle and mandrel thus forming a guide for the sleeve on both sides thereof. The mandrel is provided with an internal suction ring which is in the form of an encircling screen surface with connections to a vacuum source, a corresponding screen being arranged in the nozzle in the same vertical plane as the screen in the mandrel.

When the tube or sleeve leaves the nozzle, the forming generally speaking, is terminated, however, it can be to advantage to press out more of the remaining liquid when necessary, and such pressing can preferably be undertaken by a compressible means in the form of a collar of resilient material provided with cavities to which compressed air or other pressure medium can be supplied.

The pulp which is to be forced forwards past the suction rings and between the nozzle and the central mandrel may be continuously fed externally by pressure, or the external pressure may be varied, however, a possible solution is to arrange a reciprocal piston as a direct extension of, and controlled, by the central mandrel. The end surface of the reciprocal piston can then, to advantage also be effected as a screen surface and the fibre pulp will be dewatered to a great degree as a tube on the mandrel even before the pulp is forced in between the suction rings and mandrel and nozzle.

When the apparatus is without mandrel, and works with external pressure, it is advantageous that the passage up to the inlet of the nozzle and suction rings is conically such that the pulp on passage through the said bore is compressed, whereby a first dewatering takes place.

The invention is characterized by the features and details set forth in the claims.

Figure 2:
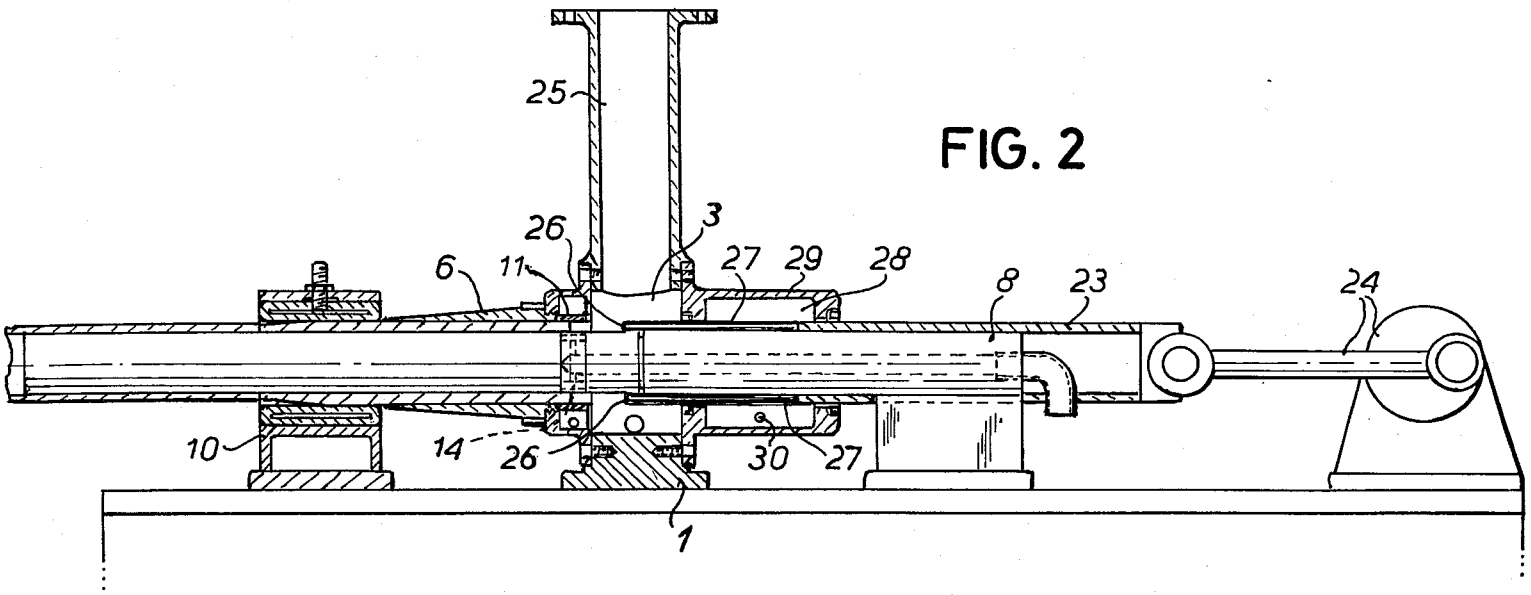

The invention is further explained in the following with reference to the drawing where;

FIG. 1 is a section through an embodiment of an apparatus for the production of sleeves of wood fibre pulp and FIG. 2 is a corresponding section through a second embodiment example.

On FIG. 1., the apparatus comprises a base 1 which supports a housing 2. The housing has a chamber 3 with a connection 4 to a store for wood fibre pulp which is under pressure. The wood fibre pulp flows in the direction indicated by the arrow 5 towards a nozzle 6 connected to an opening 7 in the housing 2. The nozzle 6 has a bore which determines the external shape and dimension of the crosssection and a mandrel 8, supported by a second base 9, projects centrally through the nozzle 6. The mandrel 8 extends towards the left on the drawing, a good distance beyond the end of the nozzle 6, and through a pressing means 10 which is further explained in the following. At the inlet of the nozzle 6 a suction ring 11 is mounted, one peripheral surface of said suction ring facing toward the bore through the nozzle, the other peripheral surface facing toward an annular channel 12 which has connection to a vacuum source through a connection 13. The internal dimension and shape of the suction ring 11 corresponds to the shape of the nozzle 6. A corresponding suction ring 14 is provided on the mandrel 8 with connection 15 to a vacuum source as indicated by 16. A part of the chamber 2 facing toward the inlet of the nozzle 6 is conically shaped as indicated by 17.

When the wood fibre pulp under pressure is forced into the chamber 3, the pulp, as stated, will move approximately as indicated by the arrow 5 and will, when sliding along the conical surface 17 on its way towards the inlet 7, be compressed, even before arriving at the nozzle 6, in the form of a tube or sleeve which slides along the mandrel 8. By means of the suction rings 11 and 14 water is drawn out by the suction effect which is due to the vacuum, and the dewatered and somewhat firmer wood fibre sleeve continues as indicated at 18, through and out of the nozzle 6. The sleeve thereafter passes through the pressing means 10 which comprises a stationary part 19 and, mounted therein, a collar 20 of rubber or other material with a cavity 21 connected to a source of vacuum through a branch 22. On supply of pulsating compressed air, the collar 20 will be compressed around the sleeve 18 when the said sleeve leaves the nozzle 6 and a further residue of water is forced out of the fibre pulp sleeve 18. The sleeve 18, when it leaves the mandrel 8 at the left hand side of FIG. 1, is relatively firm and self-supporting and, on further treatment, for example, drying, becomes as strong as is desired with respect to pre-determined wall thickness and pulp composition. In FIG. 1, the production is preferably carried out continuously and the sleeve is produced in an unending length for later division into the lengths required when the sleeves are to be used, for example, as cores in paper rolls. The wood fibre pulp can, however, also be supplied with pulsating pressure, for example, from a piston pump.

FIG. 2 illustrates an apparatus effected in accordance with the invention where the principle of FIG. 1 is developed further, a piston 23 being here mounted movable backwards and forwards on the mandrel 8. The piston is operated by a crank and a crank arm 24 which ensures the reciprocal movement. The construction and mode of operation is otherwise the same as explained with reference to FIG. 1, with suction rings 11 and 14 on both sides of the inlet to the nozzle 6. The pulp which is filled into the chamber 3 through the passage 25 is compressed on the mandrel 8 by means of the reciprocal movement of the piston 23 and forced past the suction rings 11, 14, through the nozzle 6 and past the pressing means 10.

When the piston 23 is used, it is advantageous to effect the front 26 of the piston also as a suction surface in the form of a screen which has connection to a vacuum source through channels 27 opening into an annular chamber 28 in an auxiliary housing 29.

In this manner, the moist wood fibre pulp, even before being compressed by the movement of the piston to the left of the drawing, is dewatered in that liquid is drawn both through the front 26 of the piston 23 and through the suction rings 11 and 14, and the said dewatering continues during movement of the piston. Despite the fact that it is a question here of continuous dewatering of the wood fibre pulp, the pulp when it enters the inlet between the suction rings 11, 14, is still so soft that the reciprocating piston forces the fibre pulp portions together to a homogenous mass with no trace of joints on each working stroke and thereby also no indication of breaks, the inside of the nozzle 6, as explained with reference to FIG. 1, forming the outside of the sleeve and the mandrel 8 the inside thereof such that the sleeve, also with intermittent supply of fibre pulp to the nozzle 6, is discharged therefrom as a homogeneous article with smooth outer and inner sides.

The example shown serves merely to illustrate the invention and forms no restriction to the scope of protection afforded by this patent, it being possible to envisage other embodiment examples where liquid in a suspension is removed to a great extent through suction rings before the pulp is forced into a nozzle where it is formed to the object it is desired to manufacture.

I claim:

1. An apparatus for the manufacture of sleeves of fiber pulp comprising:

first dewatering means including suction means for dewatering the fiber pulp;

nozzle means for discharging the sleeves of fiber pulp, said nozzle means having a tubular nozzle body, a portion of the interior surface of said nozzle body including an annular first screen member which acts as a portion of said first dewatering means;

a mandrel extending longitudinally through said nozzle body;

second dewatering means including suction means for dewatering the fiber pulp; and reciprocable piston means which is reciprocable along a given axis for driving the fiber pulp through said nozzle means, said reciprocable piston means being mounted on said mandrel, wherein one end of said reciprocal piston means includes a surface which extends radially outward from said mandrel, is spaced from said axis and exerts a pressure force on the fiber pulp through said nozzle means, said surface of said one end of said reciprocable piston means including a second screen member acting as a portion of said second dewatering means.

2. An apparatus for the manufacture of sleeves of fiber pulp according to claim 1 wherein a portion of the exterior surface of said mandrel includes an annular third screen member which acts as a portion of said first dewatering means.

3. An apparatus as in claim 2, wherein said first and third annular screen members are arranged in the same radial plane through the nozzle axis.

4. An apparatus as in claim 2, wherein said nozzle means has a conical inlet, tapering towards the nozzle outlet.

5. An apparatus as in claim 2, and further comprising a compressible means at the outlet of the said nozzle means, for pressing out water residue from the sleeve leaving the said nozzle means.

6. In an apparatus as in claim 5, said compressible means comprising a collar of resilient material said compressible means having a cavity with a connection means to a supply of compressed air.

7. An apparatus for the manufacture of sleeves of fiber pulp comprising:

first dewatering means including suction means for dewatering the fiber pulp;

nozzle means for discharging the sleeves of fiber pulp, said nozzle means having a tubular nozzle body;

a mandrel extending longitudinally through said nozzle body, a portion of the exterior surface of said mandrel including an annular first screen member which acts as a portion of said first dewatering means;

second dewatering means including suction means for dewatering the fiber pulp; and reciprocable piston means which is reciprocable along a given axis for driving the fiber pulp through said nozzle means, said reciprocable piston means being mounted on said mandrel, wherein one end of said reciprocable piston means includes a surface which extends radially outward from said mandrel, is spaced from said axis and exerts a pressure force on the fiber pulp put through said nozzle means, and said surface of said one end at said reciprocable piston means includes a second screen member acting as a portion of said second dewatering means.

* * * * *